United States Patent [19]

Hamel

[11] 4,351,377

[45] Sep. 28, 1982

[54] LOG SPLITTER

[76] Inventor: Daniel L. Hamel, 3250 Twin Lake Rd., St. Paul, Minn. 55110

[21] Appl. No.: 214,342

[22] Filed: Dec. 8, 1980

[51] Int. Cl.[3] ..... B27L 7/00

[52] U.S. Cl. ..... 144/193 A; 144/3 K

[58] Field of Search ..... 144/3 K, 193 R, 193 A

[56] References Cited

U.S. PATENT DOCUMENTS

| | | | |
|---|---|---|---|
| 3,319,675 | 5/1967 | Bles, Sr. | 144/193 A |
| 4,141,396 | 2/1979 | McCallister | 144/193 A |
| 4,239,070 | 12/1980 | Burns | 144/193 A |

*Primary Examiner*—W. D. Bray

*Attorney, Agent, or Firm*—Thomas J. Nikolai

[57] ABSTRACT

A log splitter having a frame with a rail extending therealong, and with a log supporting bed with laterally disposed work receiving cradles arranged to move reciprocably along the rail. The frame carries the movable bed, with the bed being provided with log engaging faces at opposed ends thereof. A double-faced log splitting wedge is secured to the rail generally midway of the stroke motion of the bed, with the log splitting wedge being arranged to engage and split logs traveling within the bed. Means are provided for delivering fluid under pressure to a double-acting ram which is secured to the frame and to the movable bed, with the ram being adapted to move the bed along the reciprocatory path. A pair of split work-receiving cradles are secured to the bed and are arranged in oppositely disposed relationship laterally of the frame for receiving split log product from the splitter.

2 Claims, 9 Drawing Figures

LOG SPLITTER

BACKGROUND OF THE INVENTION

The present invention relates generally to a log splitter, and more specifically to a log splitter having a double-acting bed for moving logs to be split along a reciprocatory path. A double-faced splitting wedge is disposed generally midway of the stroke of the bed, and thus is capable of splitting logs moving in either of the two opposed directions of motion. More specifically, however, the present invention relates to such a log splitter having a pair of split log supporting carriers secured laterally of the bed and being arranged in oppositely disposed relationship of the frame and bed for receiving the split log product. The split log supporting carrier moves with the cradle so as to be properly positioned at the moment the split log product drops from the cradle into the carrier, and thereafter may be either split further, or placed in a stack of finished work for ultimate disposal.

Hydraulically actuated log splitters have been known in the past, and are normally provided with a movable bed means actuated or driven by a hydraulic ram and normally with a single engaging or pusher face. Certain of these devices have utilized a double-acting ram so as to have a power stroke in either of two opposed directions of motion. Normally, the double-acting ram was attached to a movable blade, with this configuration adding considerable fabrication complexity and operating difficulty to the splitter device. In the past, however, these devices have been operated in a fashion such that the split log product is permitted to drop onto the ground and rests there until removed for additional splitting, or stacked.

In the apparatus of the present invention, however, cradles or carriers for the split log product are arranged laterally of the reciprocably moving bed, with these cradles moving along with the bed as it traverses its working path. These cradles permit the operator to remove the split log product from a substantially higher elevation than would otherwise be possible, and since the cradles move with the bed, they are always in the proper position to intercept and support the split log product as it falls and to position the log for further splitting by simply rotating it back into position in the system.

SUMMARY OF THE INVENTION

Therefore, it is a primary object of the present invention to provide an improved portable log splitter having a log supporting bed operable in either of two opposed directions of motion, and wherein the bed is provided with a pair of laterally disposed split log supporting cradles or carriers to receive split log product from the splitter apparatus.

It is yet a further object of the present invention to provide an improved portable log splitter utilizing a work supporting bed with log engaging pusher faces at opposed ends thereof, and with a double-faced log splitting wedge being disposed generally midway of the stroke of the bed, and wherein the bed is provided with a pair of laterally disposed log supporting cradles secured directly to the movable bed and being arranged to receive split log product therefrom.

Other and further objects of the present invention will become apparent to those skilled in the art upon a review of the following specification, appended claims and accompanying drawings.

IN THE DRAWINGS

DESCRIPTION OF THE PREFERRED EMBODIMENT

Figure 1:
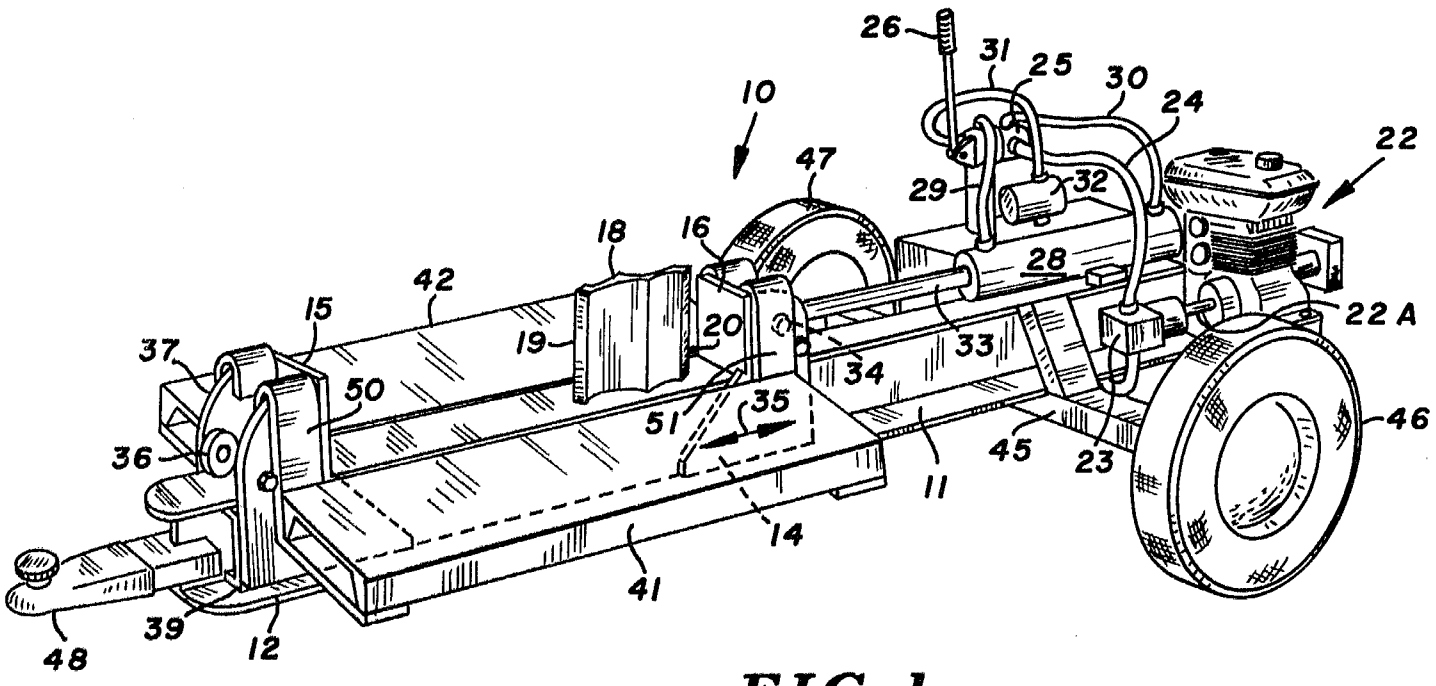
FIG. 1 is a perspective view of the log splitter apparatus of the present invention.
Figure 2:
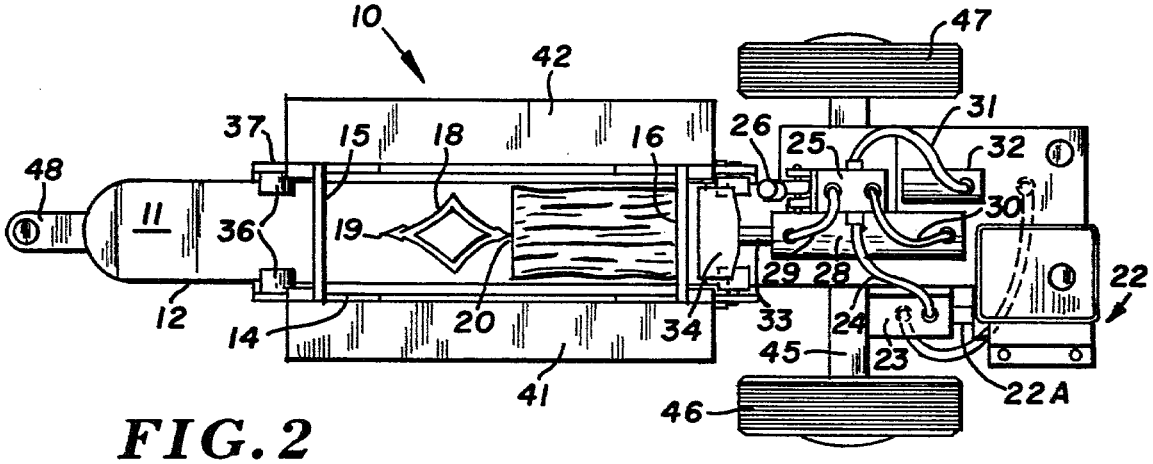
FIG. 2 is a top plan view of the apparatus illustrated in FIG. 1, and illustrating a log as it is positioned at a point where initial contact is made between the log and the splitting wedge.
Figure 3:
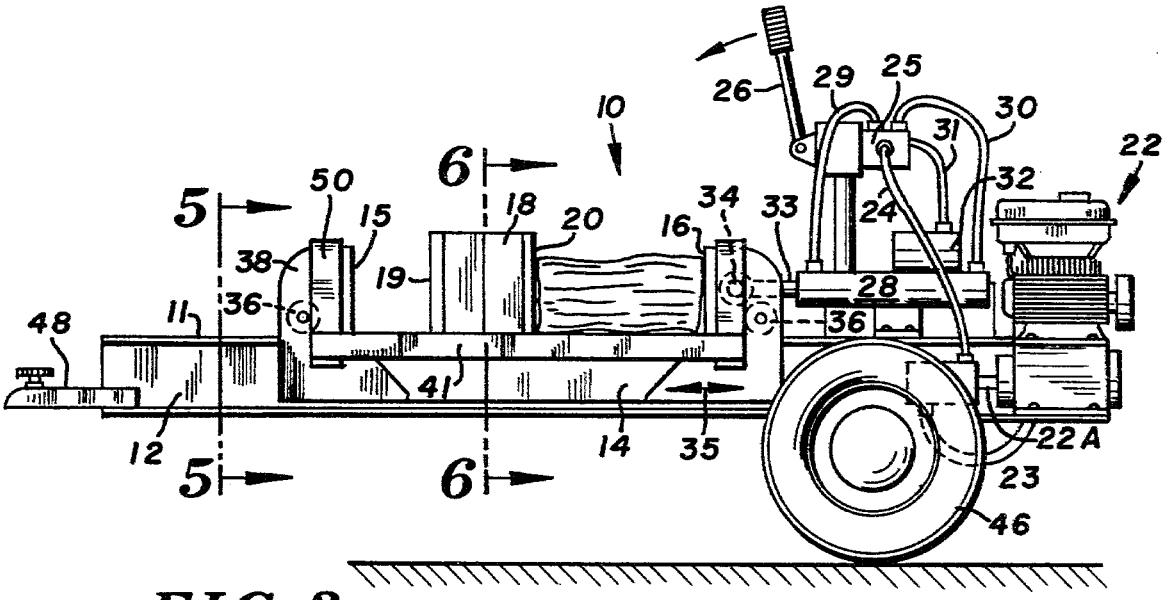
FIG. 3 is a side elevational view of the apparatus as illustrated in FIG. 2.
Figure 4:
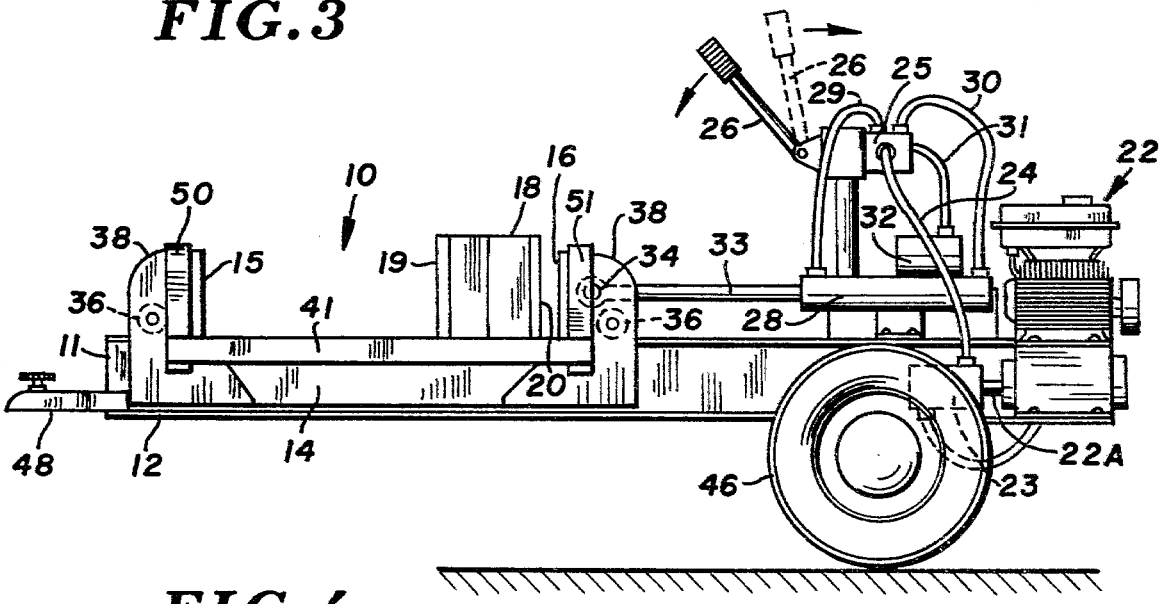
FIG. 4 is a view similar to FIG. 3, and illustrating the device upon completion of a power stroke from right to left.

In accordance with the preferred embodiment of the present invention, and with particular attention being directed to FIG. 1 of the drawings, the log splitter generally designated 10 includes frame means 11, the frame means including an elongated rail 12 in the form of an "I" beam, with the rail providing a support surface for the log transporting bed generally designated 14. The bed 14 is provided with a pair of opposed log engaging pusher faces as at 15 and 16, with the bed being adapted to move reciprocably along the rail between the dispositions illustrated in FIGS. 3 and 4.

A log splitting wedge is provided as at 18, with the wedge having a pair of log splitting surfaces or blade ends at 19 and 20, with this apparatus providing for splitting contact with a log moving within the bed in either direction of motion.

Figure 7:
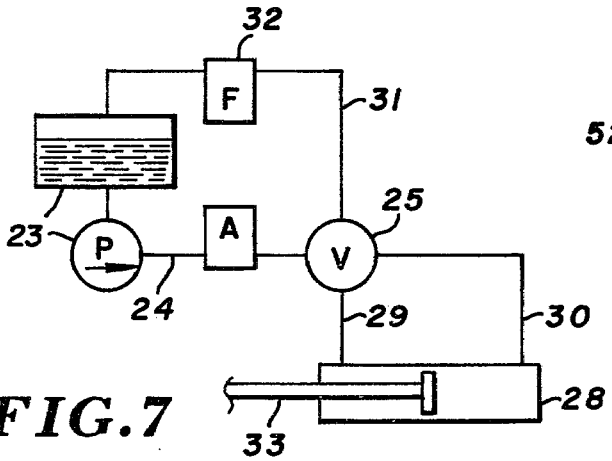
FIG. 7 is a schematic diagram of a typical hydraulic circuit which is usable in connection with the apparatus of the present invention.
Figure 8:
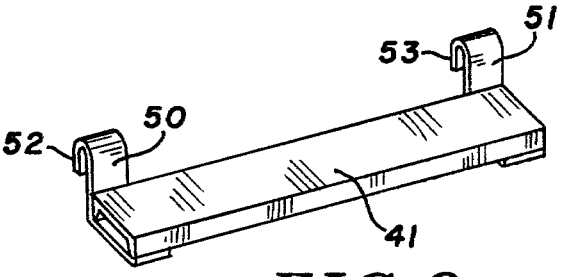
FIG. 8 is a perspective view, on a slightly reduced scale, of one of the split log supporting carriers of the present invention.

Power supply means are provided for delivering fluid under pressure, with the power supply means including a gas engine as shown generally at 22, together with a hydraulic pump and reservoir combination as at 23. A high pressure supply conduit is shown at 24 for delivering fluid under pressure to the selector valve 25, selector valve 25 being controllably positioned by operating handle 26. Selector valve 25 is arranged to couple the source of high pressure fluid to a hydraulic cylinder 28 having a ram 33 through conduits 29 or 30, with these same conduits being utilized for return of fluid to the reservoir through line 31. A hydraulic fluid filter is available as at 32 for maintaining the fluid free of contaminants. With attention being directed briefly to the schematic diagram of FIG. 7, it will be seen that an accumulator 27 may be provided in the high pressure line so as to assist the pump during periods of high capacity requirements.

Cylinder 28 is provided with a ram as at 33, with ram 33 being a double-acting ram, the free end of which is coupled to drive pin 34. Accordingly, the double-acting motion of ram 33 will be translated into reciprocatory motion of bed 14 in accordance with the directions of motion illustrated by double-headed arrow 35.

In order to provide for a reduction of friction between bed 14 and rail 11, wheeled supports may be provided as at 36, with these wheeled supports being journaled for rotation within the end faces of bed 14, such as end faces 37 and 38.

Figure 5:
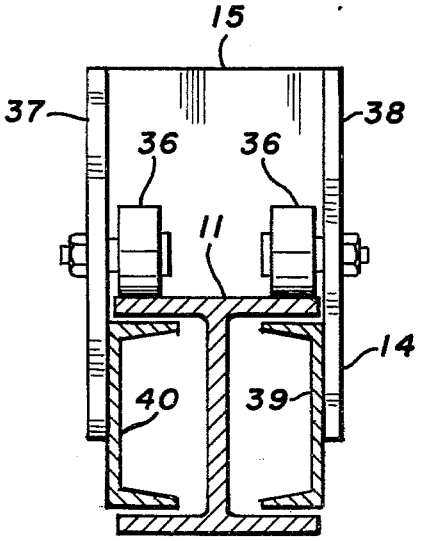
FIG. 5 is a vertical sectional view taken along the line and in the direction of the arrows 5—5 of FIG. 3.
Figure 6:
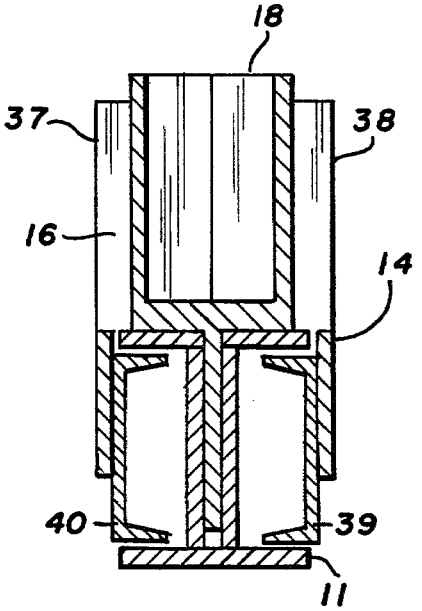
FIG. 6 is a vertical sectional view taken along the line and in the direction of the arrows 6—6 of FIG. 3.

With attention being directed briefly to FIGS. 5 and 6 of the drawings, it will be noted that end faces 37 and 38 have inwardly extending channel portions as at 39 and 40 to assist the moving bed in maintaining a substantially uniform flat rail engaging disposition.

Figure 9:
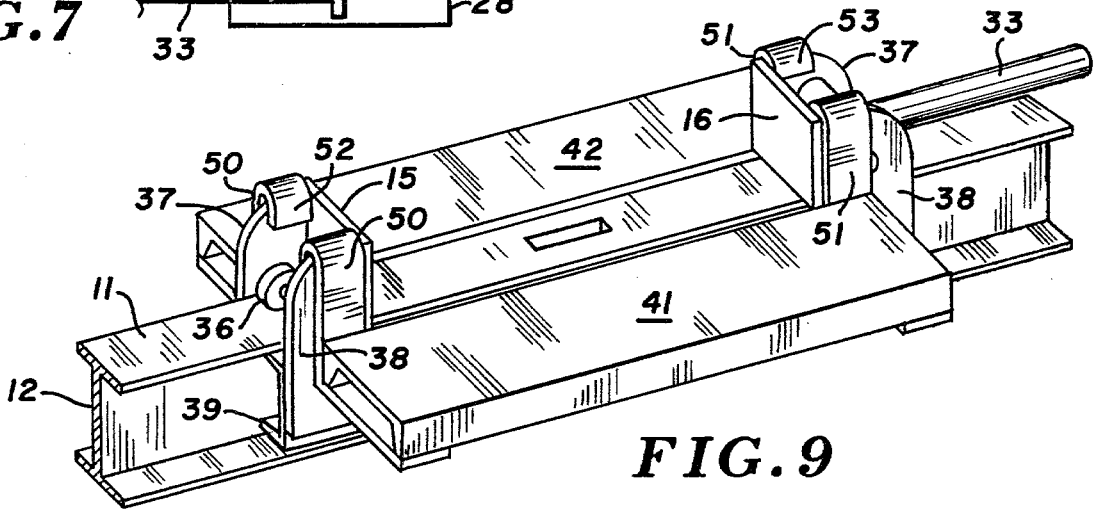
FIG. 9 is a perspective view of the forward portion only of the frame rail and the log supporting cradle, with FIG. 9 also being on a slightly reduced scale.

Bed 14 is provided with a pair of laterally disposed split log supporting cradles, as at 41 and 42. These split log cradles or carriers are adapted to receive and retain split log product from the apparatus, and are arranged to move along with the bed and thus receive the split log product reliably. The arrangement is shown in greater detail in FIG. 9, it being noted, however, that the log splitting wedge is shown as removed from the view of FIG. 9.

In order to provide for portability of the unit, a wheeled support is provided for rail 11 by means of axle 45, along with wheels 46 and 47. For releasably coupling to a vehicle, a conventional trailer hitch is shown at the fore end as at 48. While a gasoline engine has been shown at 22, it will be appreciated that an electrically powered system or device may be utilized as well for certain applications. In such a situation, the output shaft of engine 22, such as shaft **22*a***, would simply be the output or motor shaft of a suitable electrically powered motor. Also, it will be appreciated that other hydraulic supply systems may be utilized, with other fluids being utilized in certain instances, such as a compressible fluid.

In order to provide for removal of the split log supporting cradles 41 and 42 from the structure, support brackets 50 and 51 are provided, with suitable in-turned ends as at 52 and 53 respectively. It will be appreciated, of course, that other means may be provided for securing the split log supporting cradles to the bed.

I claim:

1. A log splitter comprising, in combination:

(a) a frame including an elongated flanged rail;

(b) an elongated bed reciprocable along said rail through a range of travel and having pusher faces at its ends extending away from said rail and spaced by a distance greater than the travel of said bed on said rail, said bed including roller means carried at the ends thereof, for engaging the top of said rail to support said bed thereon, and guide means extending the full length of said bed for cooperating with the flanges of said rail to limit the motion of the bed to travel longitudinal of the rail;

(c) a pair of log support cradles removably carried by the ends of said bed and extending therebetween, said cradles projecting laterally beyond said rail on opposite sides thereof;

(d) a double edged splitting wedge removably secured to said rail between said pusher faces of said bed, the length of said bed between said pusher faces being no less than the sum of the longitudinal dimension of said wedge added to the length of a log to be split, and the travel of said bed being no less than the length of a log to be split; and (e) reversable power means connected to said rail and said bed and operable to apply force to said bed along a line passing longitudinally through said wedge and said pusher faces.

2. In a log splitter having:

(a) frame means and an elongated rail means within said frame means;

(b) a log supporting and driving bed arranged to move reciprocably along said rail, and having log engaging faces at opposed ends thereof;

(c) a log splitting wedge disposed along said rail and between said log engaging faces, and having oppositely disposed blade surfaces, and with each blade surface being arranged for splitting contact with a log moving within said bed;

(d) power supply means for delivering fluid under pressure, and double-acting ram means secured to said frame means and to said bed means and being operatively coupled to said power supply means for actuating said ram means so as to move said bed means along said reciprocatory path; and (e) a pair of log supporting carriers secured to said bed means and arranged for movement therewith, and being arranged in oppositely disposed relationship laterally of said rail for receiving split log product.

* * * * *